US006513211B1

(12) United States Patent
Fisher

(10) Patent No.: US 6,513,211 B1
(45) Date of Patent: Feb. 4, 2003

(54) DOUBLE HELIX SHOE LACING PROCESS

(76) Inventor: Montgomery Kim Fisher, 12703 Ardennes Ave., Rockville, MD (US) 20851-1903

( * ) Notice: Subject to any disclaimer, the term of this patent is extended or adjusted under 35 U.S.C. 154(b) by 0 days.

(21) Appl. No.: 09/916,834

(22) Filed: Jul. 28, 2001

(51) Int. Cl.[7] ..... A43C 1/00; A43C 11/00; A43B 11/00

(52) U.S. Cl. ..... 24/712; 24/713.6; 24/714.1; 24/714.8; 36/50.1

(58) Field of Search ..... 24/712, 713.6, 24/714.1, 714.8, 715; 36/50.1

(56) References Cited

U.S. PATENT DOCUMENTS 6,282,817 B1 * 9/2001 Curet ..... 36/50.1

* cited by examiner

*Primary Examiner*—Victor Sakran

(57) ABSTRACT

A process for lacing shoes, for use with any shoe with lace-holes and any shoelace. The process results in shoelaces that follow a path that describes a double-helix, resulting in reduced friction and faster and easier tightening and loosening.

8 Claims, 23 Drawing Sheets

DOUBLE HELIX SHOE LACING PROCESS

FIELD OF THE INVENTION

The process of the present invention relates to shoes, in particular a process for lacing shoes that is useful with any type of shoelaces and most types of shoes.

BACKGROUND OF THE INVENTION

The prior art comprises variations on two common processes for lacing shoes, and numerous inventions attempting to overcome the difficulties associated with those processes. The most frequently used processes for shoe lacing involve a crisscross pattern, two popular variations of which are illustrated in FIGS. 1 and 2, each with four pairs of lace-holes. The other frequently used processes are used primarily to achieve the aesthetically-pleasing "ladder" pattern, two popular variations of which are illustrated in FIGS. 3 and 4, each with four pairs of lace-holes. Shoes laced by these processes are relatively difficult and time-consuming to loosen and tighten. These problems result from two causes: (1) friction resulting from the shoelaces crossing each other and the edges of the shoe upper, and (2) the requirement that the shoelaces be pulled in different directions or for excessive length.

The cause of the high friction effects experienced by these processes can be readily perceived by counting the number of lace-over-lace crossings on the same side of the shoe upper, represented by "a", and the number of crossings of a shoelace against the edges of the shoe upper in going from one side to the other, represented by "b". Other sources of friction, such as the shoelace passing through the lace-hole, and contact of the shoelaces with the shoe upper and/or tongue surfaces, are essentially equivalent in all of the prior art processes, as well as the process of the present invention, and therefore can be disregarded for the purpose of comparison. For a shoe with a number of pairs of lace-holes "n", it can be readily seen that the common processes result in the following amount of friction from these effects:

| Prior Art Process | FIG. | Number of Lace/Lace Crossing Effects, a | + | Number of Lace/Edge Crossing Effects, b |
|---|---|---|---|---|
| basic crisscross | 1 | (n − 1) | + | 2 × (n − 1) |
| X-crisscross | 2 | (n − 1) | + | 0 |
| basic ladder | 3 | (n − 1) | + | 0 |
| single-helix ladder | 4 | (n − 1) | + | 0 |

Thus, the friction effects from lace-over-lace crossing, a, for all of these processes increase in direct proportion to the number of lace-holes, n. In addition, the basic crisscross process results in substantial effects from shoelaces coming into contact with edges of the shoe upper in going from one side to another, b, which also increase in direct proportion to the number of lace-holes, n. As a result, the cumulative effects are moderate with dress or casual shoes (typically 3–4 holes), significant with athletic-type shoes (typically 5–8 holes), and extremely significant with boots such as military or hunting boots (9–12+holes).

The problem with the direction that the shoelaces must be pulled to loosen and tighten the shoes is identical in the two crisscross processes. To loosen or tighten a crisscross-laced shoe, the wearer must pull on shoelace segments that cross each other, in a manner causing them to move in opposite directions. If the wearer of a shoe laced by the basic crisscross process as illustrated in FIG. 1 attempts to loosen two crossing shoelace segments simultaneously by inserting a finger under them and lifting, the combination of the friction from the shoelaces sliding across each other above the finger (a), and the friction from the shoelaces sliding against the edge of the shoe upper (b), results in substantial resistance and concomitant discomfort. The wearer of a shoe laced by the X-crisscross process as illustrated in FIG. 2 experiences the same resistance from the moving crossed shoelaces (a), but while this process does not involve laces sliding against the edges of the shoe upper, it does involve added resistance from the crossed shoelaces on the underside of the shoe upper (a). Alternatively, the wearer of a crisscross-laced shoe can use both hands to loosen the shoelaces. As a practical matter, tightening shoes laced by a crisscross process requires the use of both hands.

Neither ladder process gives the wearer any external indication of which direction the shoelace segments need to be pulled to loosen them. The basic ladder process as illustrated in FIG. 3 must be loosened by pulling each successive shoelace segment in the opposite direction, against the friction resulting from the crossed shoelaces on the underside of the shoe upper, a. A shoe laced by the single-helix ladder process as illustrated in FIG. 4 is loosened and tightened using just the long shoelace end that spirals through all of the lace-holes except for one at the top. While this process can be performed using just one hand, it is tedious. If the shoelace is of such a length that the lace-end available for tying is the same length as the other lace-end when the shoelaces are fully tightened, then loosening the shoelace requires the wearer to unlace the spiraling shoelace sufficiently to remove the shoe, and tightening requires re-lacing. If the shoelace is sufficiently long to allow loosening without unlacing, then after tightening the wearer must tie a knot with one relatively short shoelace end and one relatively long one. This disadvantage increases with the number of pairs of lace-holes and is therefore greatest in boots with numerous lace-holes.

Finally, all of the prior art lacing processes result in shoelace segments with an orientation that increases the likelihood that the shoelace segments will catch or snag on underbrush or other materials with which the shoe comes into contact during forward movement. The prior art lacing processes also all result in shoelace segments with an orientation that increases resistance to the movement of air across the shoe surface.

While numerous inventions have striven to overcome the problems inherent in the common processes of shoe lacing, all have required that the shoe and/or shoelace be custom-made to obtain the inventions' benefits. For example, Torppey (U.S. Pat. No. 5,027,482), Quellais (U.S. Pat. No. 5,345,697), Louviere (U.S. Pat. No. 5,353,483), Hyde (U.S. Pat. No. 5,357,691), Nichols (U.S. Pat. No. 5,469,640), Donnadieu (U.S. Pat. No. 5,537,763), and Veylupek (U.S. Pat. No. 5,755,044) describe shoes in which, after the shoelaces have been adjusted for a desired fit, the shoelaces can be loosened or adjusted by releasing or moving part of the lacing mechanism. McElroy (U.S. Pat. No. 595,833), Derderian (U.S. Pat. No. 4,553,342), Autry (U.S. Pat. No. 4,670,949) Nichols (5,042,120), Berger (U.S. Pat. No. 5,117,567), Crowley (U.S. Pat. No. 5,682,654), and Maurer (U.S. Pat. No. 6,219,891) describe shoes with specialized lacing mechanisms. Bertrand (U.S. Pat. No. 431,737), Dumke (U.S. Pat. No. 864,774), Peterson (U.S. Pat. No. 1,256,254), Gatti (U.S. Pat. No. 3,703,775), Klausner (5,016,327), and Sink (U.S. Pat. No. 5,471,769) use a single specialized shoelace fixed at the bottom of the lacing area which proceeds through pairs of parallel lace-holes and/or hooks in either a zig-zag or single-helix path, with specialized means to secure the shoelace at the top of the shoe. Scott (U.S. Pat. No. 796,258), Oberg (U.S. Pat. No. 1,450,047), Nelson (U.S. Pat. No. 3,059,518), Streule (U.S. Pat. No. 3,205,544), Dassler (U.S. Pat. No. 3,626,610), Famolare (U.S. Pat. No. 4,114,297), Swinton (U.S. Pat. No. 4,247,967), Lin (U.S. Pat. No. 4,571,856), Chassaing (U.S. Pat. No. 4,577,419), Oatman (U.S. Pat. No. 4,592,154), DeRenzo (U.S. Pat. No. 4,640,025), Ingram (U.S. Pat. No. 4,777,705), Rosen (U.S. Pat. No. 4,967,492), Batra (U.S. Pat. Nos. 5,184,378; 5,271,130), McDonald (U.S. Pat. No. 5,319,869), Brown (U.S. Pat. No. 5,526,585), Dewey (U.S. Pat. No. 5,894,640), Bowen (U.S. Pat. No. 6,049,955), Oreck (U.S. Pat. No. 6,052,921), and Ritter (U.S. Pat. No. 6,128,835) describe specialized shoelaces or other devices for enhancing the fit or securing the shoe on the wearer's foot. Brown (U.S. Pat. No. 705,817), Kroell (U.S. Pat. No. 923,860), Woods (U.S. Pat. No. 1,022,808), Keyes (U.S. Pat. No. 1,507,189), Revny (U.S. Pat. No. 3,710,486), Maslow (U.S. Pat. No. 4,458,373), Keech (U.S. Pat. No. 5,040,274), Lavinio (U.S. Pat. No. 5,088,166), Carroll (U.S. Pat. No. 5,157,813), Gessner (U.S. Pat. No. 5,158,428), Posner (U.S. Pat. No. 5,349,764), Lerhman (U.S. Pat. No. 5,778,499), Kissner (U.S. Pat. No. 5,997,051), Zebe (U.S. Pat. No. 5,996,256), Maurer (U.S. Pat. No. 6,119,318), and Dickie (U.S. Pat. No. 6,148,489) describe specialized knots or other devices for securing shoelaces. Smith (U.S. Pat. No. 795,073), Cascia (U.S. Pat. No. 1,583,958), and Fossa (2,418,168) show common or specialized lacing processes but are not concerned with processes for the routine lacing of shoes. None of these inventions involves a substantially different process for lacing ordinary shoes with any kind of shoelaces.

BRIEF SUMMARY OF THE INVENTION

It is an object of the process of the present invention to make the tightening and loosening of shoelaces easier and faster by minimizing the effects of friction.

It is another object of the process of the present invention to make the tightening and loosening of shoelaces easier and faster by allowing pairs of shoelace segments to be pulled in the same direction.

It is another object of the process of the present invention to reduce the likelihood that the shoelace segments on the exterior of the shoe will catch upon or be snagged by underbrush or other materials coming in contact with the shoe during forward movement.

It is a further object of the process of the present invention to reduce the resistance to the movement of air across the shoe surface resulting from the shoelaces.

The process of the present invention comprises beginning lacing the shoe through the lowest pair of lace-holes in such a manner that the shoe-lace ends are pointed in opposite directions relative to the proximal surface of the shoe upper, and continuing the lacing through the other lace-holes in such a manner that the paths followed by the two halves of the shoelace describe a double helix.

DETAILED DESCRIPTION OF THE INVENTION

Figure 1:
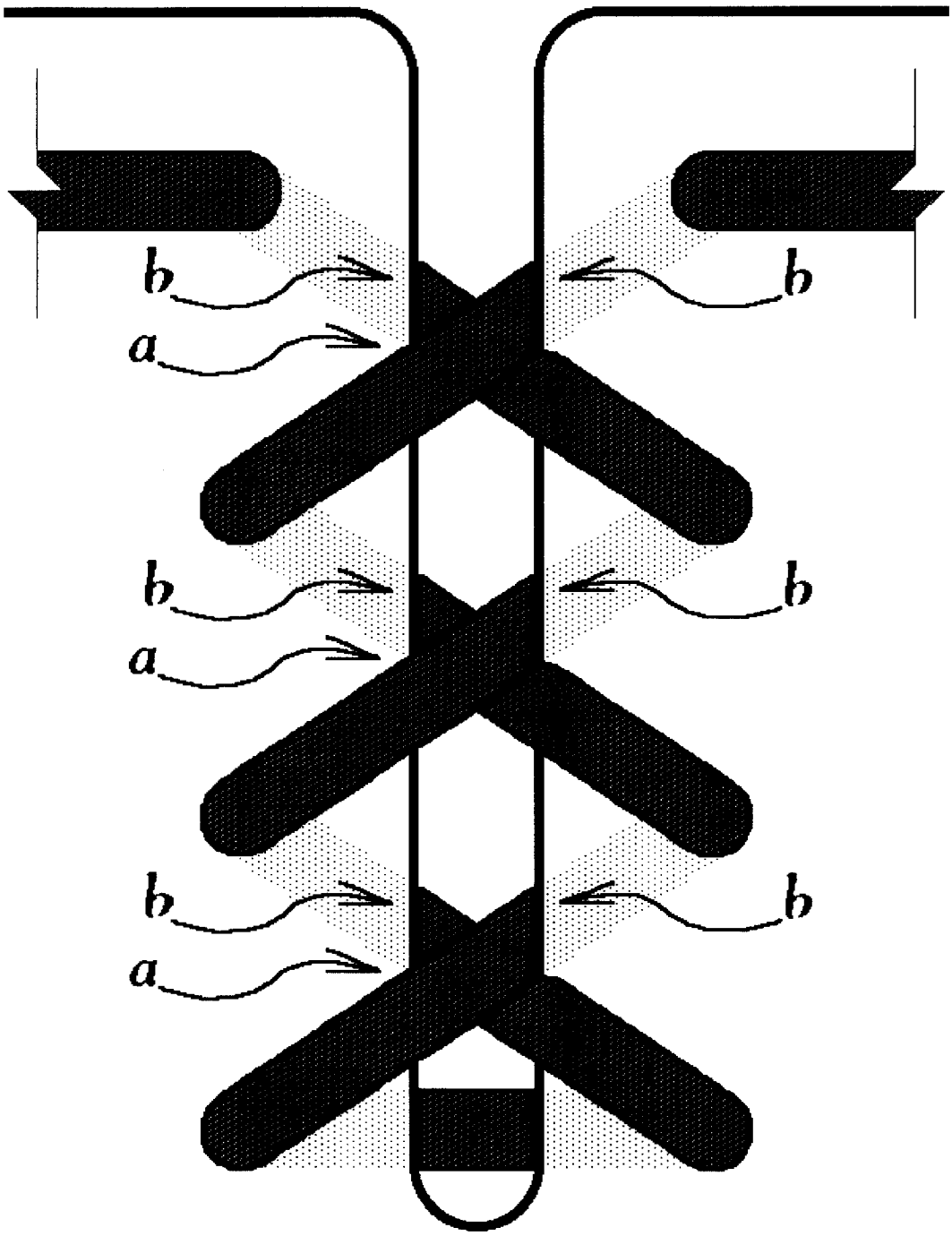
Fig. 1 Prior Art
FIG. 1 represents the prior art basic crisscross lacing process, with 4 pairs of lace-holes.

The present invention is a process for lacing a shoe with a total number of pairs of lace-holes designated "n", in which n is at least two, with individual lace-holes designated starting with the lowest as "1"through "n" on one side and "1'" through "n'" on the opposite side, and a shoelace, comprising the following sequential steps:

(1)

(a) Initial insertion of one lace-end through hole 1, entering into the underside (relative to the proximal surface of the shoe upper) of hole 1 and emerging on the upperside (relative to the proximal surface of the shoe upper).

(b) Insertion of the other lace-end through hole 1', entering into the upperside of hole 1' and emerging on the underside.

(c) Pulling the lace-ends until all of the shoelace has been pulled through holes 1 or 1', there is no substantial slack in the shoelace between holes 1 and 1', and each side of the unlaced shoelace is of approximately equal length.

(2)

(a) Insertion of the lace-end emerging on the upperside of hole 1 through hole 2', entering into the upperside and emerging on the underside.

(b) Insertion of the lace-end emerging on the underside of hole 1' through hole 2, entering into the underside and emerging on the upperside.

(c) Pulling the shoelace ends until all of the shoelace has been pulled through holes 2 or 2', there is no substantial slack in the shoelace between any of the holes with shoelaces, and each side of the unlaced shoelace is of approximately equal length.

(3) When n equals 2, lacing is complete at this point; when n is greater than 2, lacing continues by repeating the following sequential steps:

(a) Insertion of the lace-end emerging on the underside of each hole, designated as hole x or x', through the corresponding next-higher hole on the opposite side, hole [x'+1] or [x+1] respectively, entering into the underside and emerging on the upperside.

(b) Insertion of the lace-end emerging on the upperside of each hole x' or x through the corresponding next-higher hole on the opposite side, hole [x+1] or [x'+1] respectively, entering into the upperside and emerging on the underside.

(c) Pulling the shoelace ends until all of the shoelace has been pulled through holes x and x', there is no substantial slack in the shoelace between any of the holes with shoelaces, and each side of the unlaced shoelace is of approximately equal length.

Figure 5:
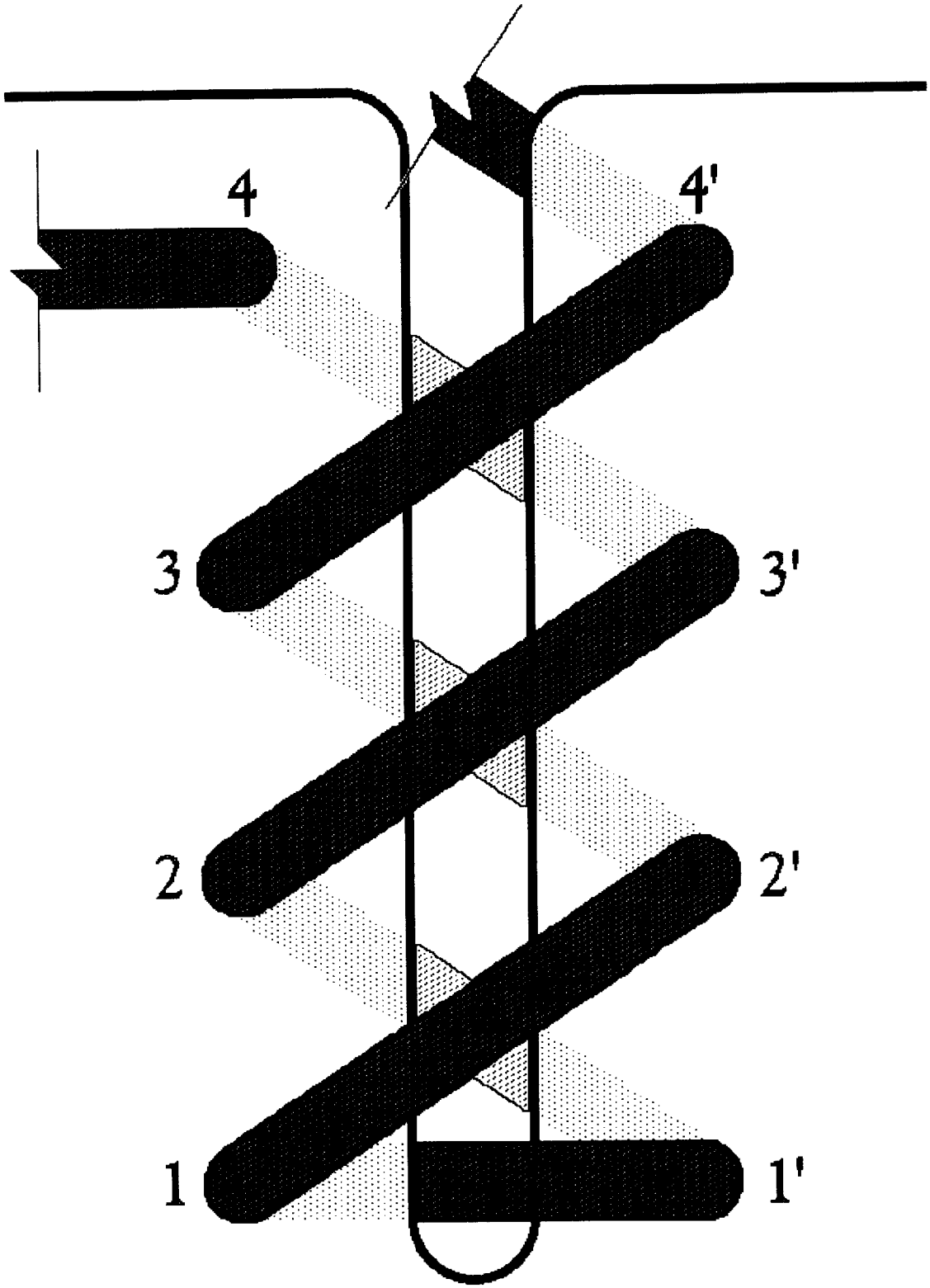
FIG. 5 represents an embodiment of the process of the present invention, with 4 pairs of lace-holes.

Step (3) is repeated until shoelaces have been inserted and pulled through all of the lace-holes on each side. FIG. 5 illustrates this embodiment of the process of the present invention, in which the double-helical lacing continues all the way to the topmost lace-holes, leaving one lace-end on the underside of the shoe upper to be secured with the other lace-end on the upperside.

Another embodiment of the process of the present invention is obtained with shoes with a total number of pairs of lace-holes designated "n", in which n is at least three, by completing steps (1) and (2), repeating step (3) until shoelaces have been inserted and pulled through the penultimate holes on each side, holes [n−1] and [n'−1], and then:

(4) Completing the lacing by the following sequential steps:

(a) Insertion of the lace-end emerging on the underside of one of the penultimate holes, [n−1] or [n'−1], into the corresponding next-higher hole on the opposite side, hole n' or n respectively, entering into the underside and emerging on the upperside.

(b) Insertion of the lace-end emerging on the upperside of the other penultimate hole, [n'−1] or [n−1], into the corresponding next-higher hole on the opposite side, hole n or n' respectively, entering into the underside and emerging on the upperside.

(c) Pulling the shoelace ends until all of the shoelace has been pulled through holes n and n', there is no substantial slack in the shoelace between any of the holes with shoelaces, and each side of the unlaced shoelace is of equal length.

Figure 6:
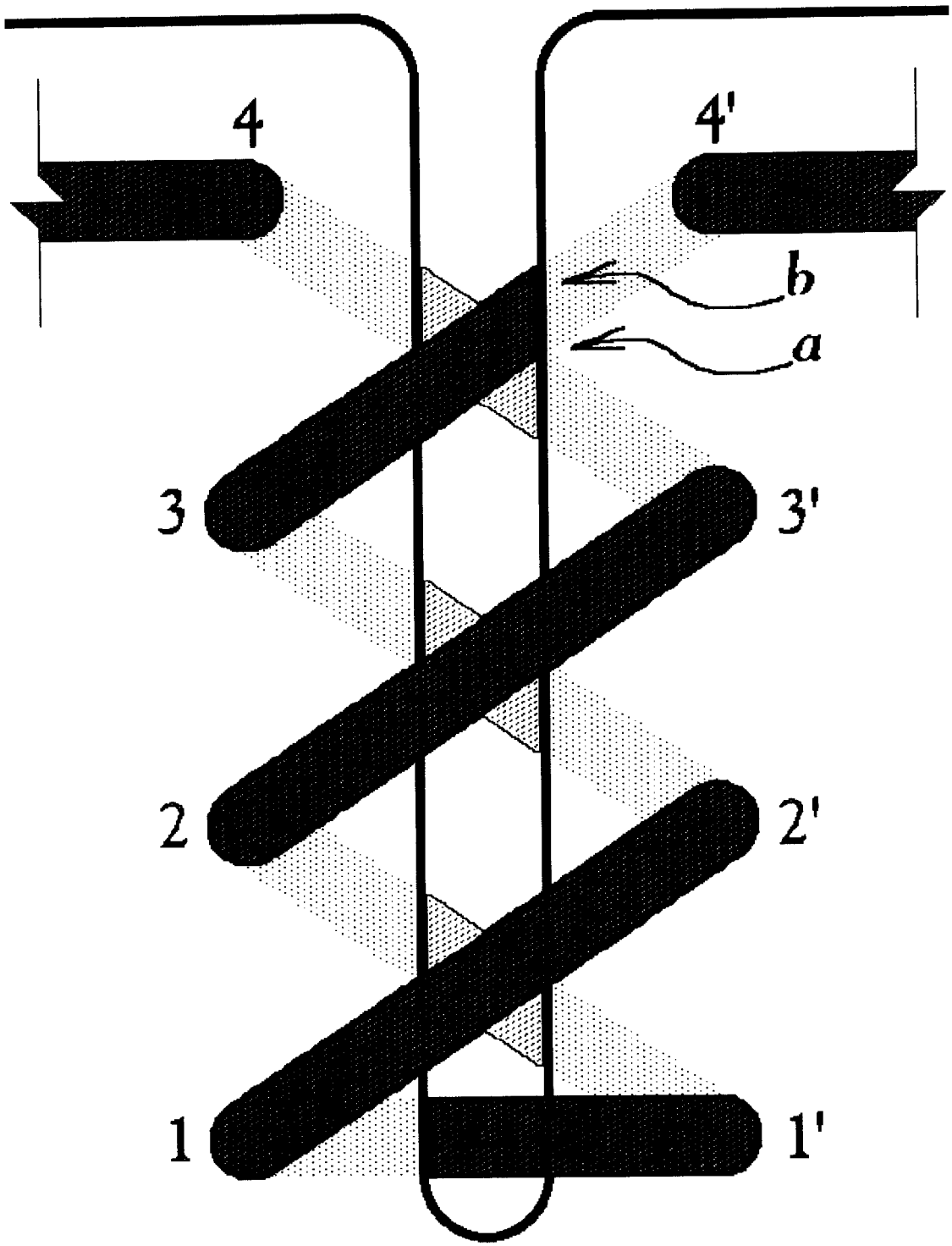
FIG. 6 represents an embodiment of the process of the present invention, with 4 pairs of lace-holes.

FIG. 6 illustrates this embodiment of the process of the present invention, in which the double-helical lacing continues until the penultimate pair of lace-holes, after which each lace-end is passed through the topmost lace-hole on the opposite site, entering the lace-hole on the underside of the shoe upper and emerging on the upperside. The embodiment of the process of the present invention illustrated in FIG. 6 achieves virtually all of the advantages of the embodiment illustrated in FIG. 5, and results in both shoelace ends on the upperside of the shoe upper for tying or other means of being secured. This result may be perceived by many users as being practically and aesthetically preferable.

Identical embodiments of the process of the present invention are obtained by reversing the order of any of the—(a) and—(b) steps described above, or by completing the process first with one shoelace end and then the other.

Comparison of FIGS. 5 and 6 with FIGS. 1, 2, 3, and 4 demonstrates how the, process of the present invention minimizes the friction effects from lace-over-lace crossings on the same side of the upper, a. For a shoe with n lace-holes, all three of the common processes result in n−1 occurrences of friction effect a. The embodiment of the process of the present invention illustrated in FIG. 5 eliminates effect a altogether. The embodiment of the process of the present invention illustrated in FIG. 6 has exactly one occurrence of effect a regardless of the total number of lace-holes, resulting in less friction from effect a for any shoe with 3 or more lace-holes—that is, whenever n is greater than 2.

Because the friction from effect a increases with each lace-hole for the common lacing processes but not the process of the present invention, the advantages of the process of the present invention increase with the number of lace-holes. Thus, the advantages are moderate with dress and casual type shoes (typically 3–4 holes), significant with athletic-type shoes (typically 5–8 holes), and extremely significant with boots such as military or hunting boots (9–12+holes).

Figure 2:
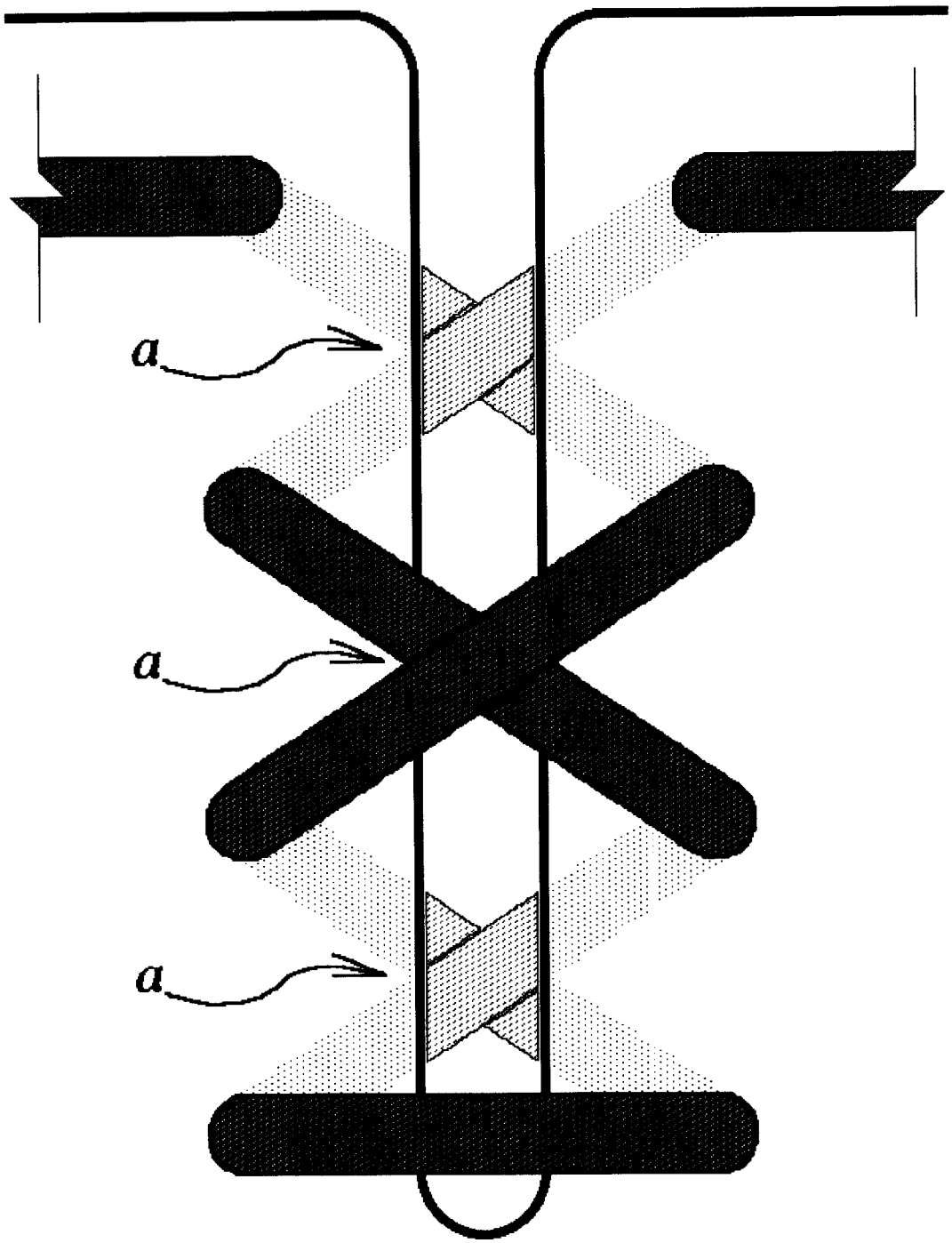
Fig. 2 Prior Art
FIG. 2 represents the prior art alternate crisscross lacing process, with 4 pairs of lace-holes.
Figure 3:
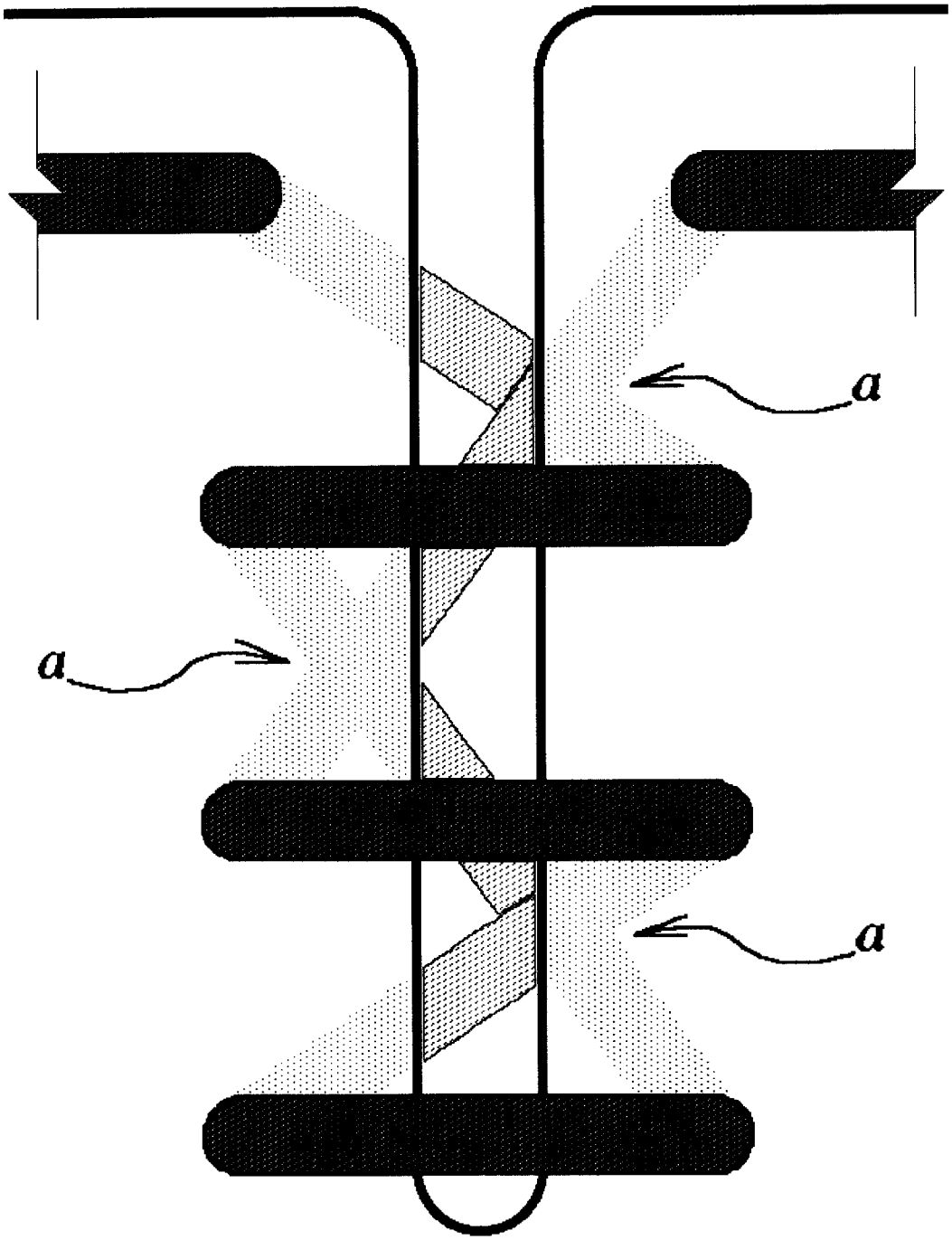
Fig. 3 Prior Art
FIG. 3 represents the prior art basic ladder lacing process, with 4 pairs of lace-holes.
Figure 4:
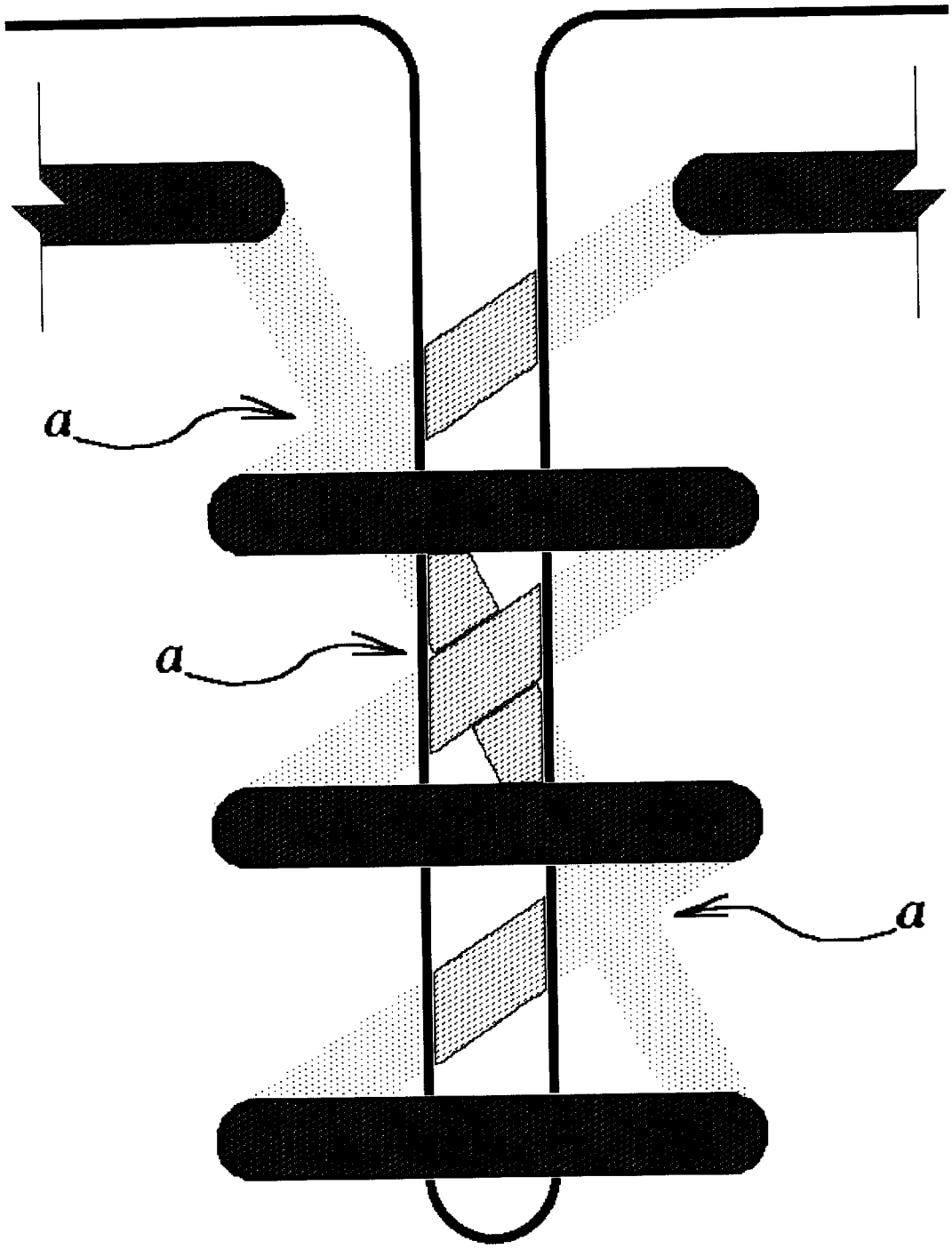
Fig. 4 Prior Art
FIG. 4 represents the prior art single-helix ladder lacing process, with 4 pairs of lace-holes.

The prior art alternate crisscross process as illustrated in FIG. 2, and ladder processes as illustrated in FIGS. 3 and 4, all avoid effect b. The process of the present invention either avoids effect b altogether, as in the embodiment illustrated in FIG. 5, or results in exactly one occurrence of effect b, as in the embodiment illustrated in FIG. 6. The basic crisscross process as illustrated in FIG. 1 results in two occurrences of effect b for each pair of lace-holes after the first pair, such that the cumulative friction resulting from effect b becomes highly significant as the number of lace-holes increases. This effect contrasts sharply with the process of the present invention as illustrated in FIG. 6, in which the significance of the single occurrence of effect b becomes proportionately insignificant as the number of lace-holes increases.

The relative significance of the friction effects, and therefore the relative advantage of the process of the present invention, increases when the shoes and shoelaces are wet and/or dirty.

Figure 7:
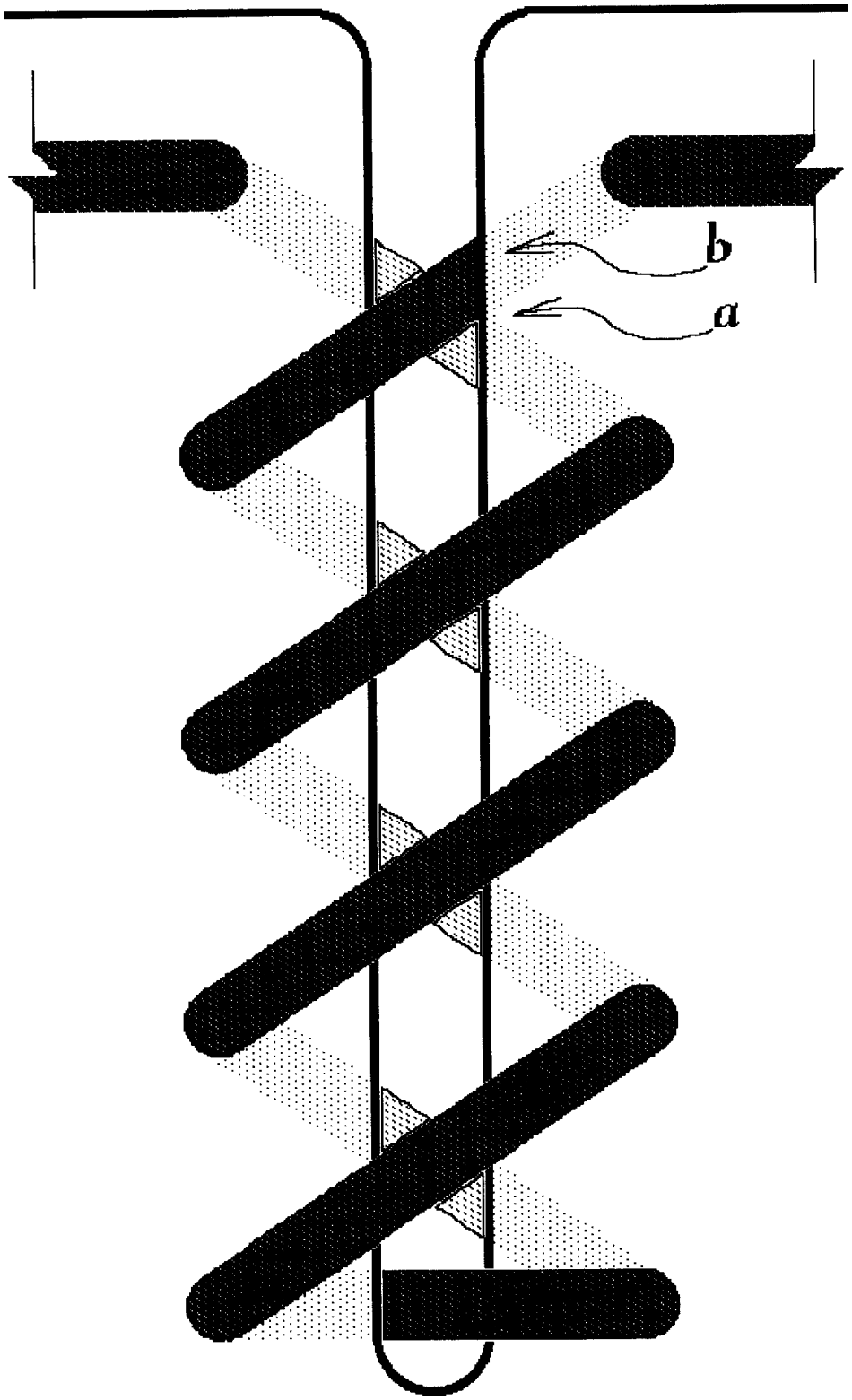
FIG. 7 represents an embodiment of the process of the present invention with 5 pairs of lace-holes.
Figure 8:
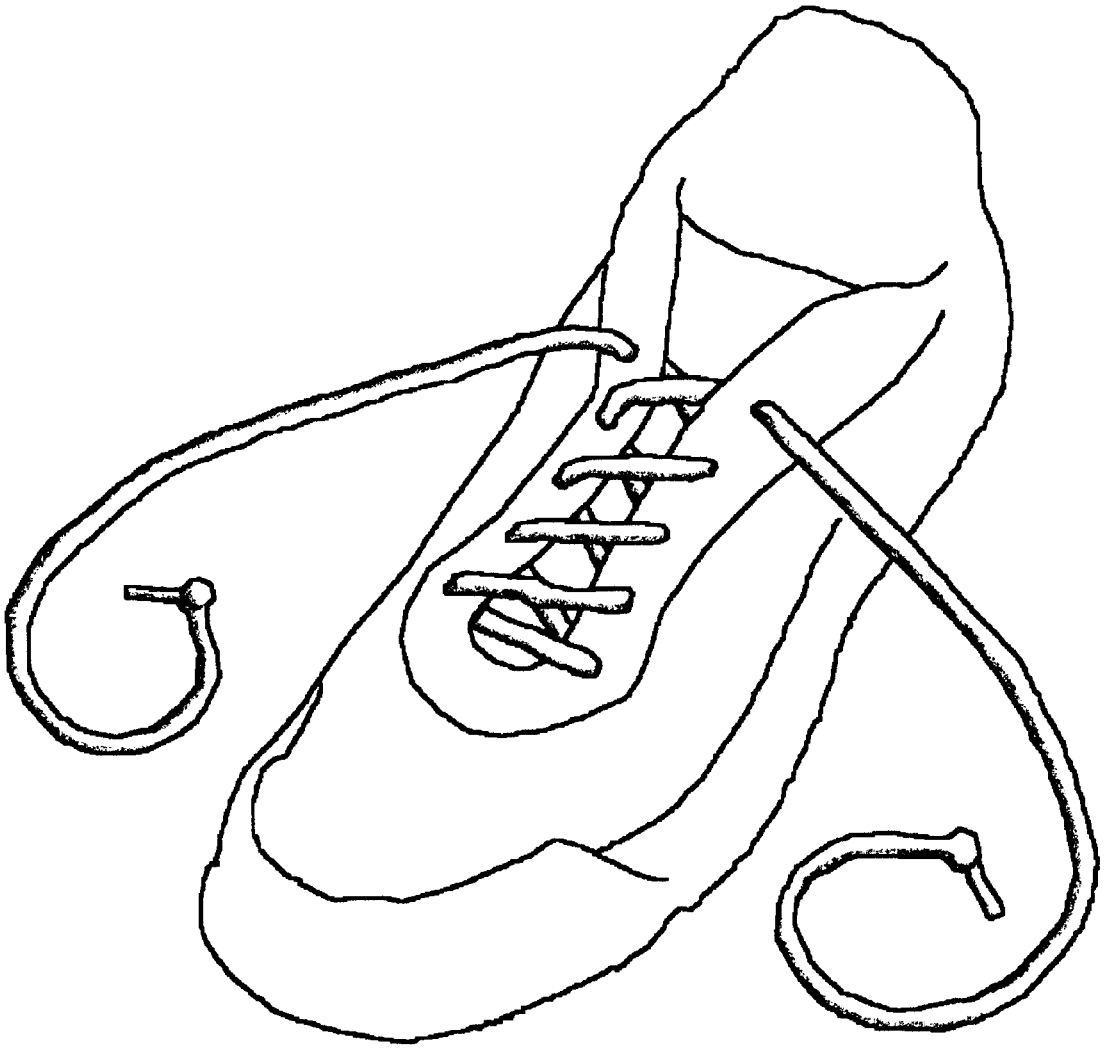
FIG. 8 is a perspective view of an athletic-type shoe with 5 pairs of lace-holes, fully laced by the process of the present invention.
Figure 9:
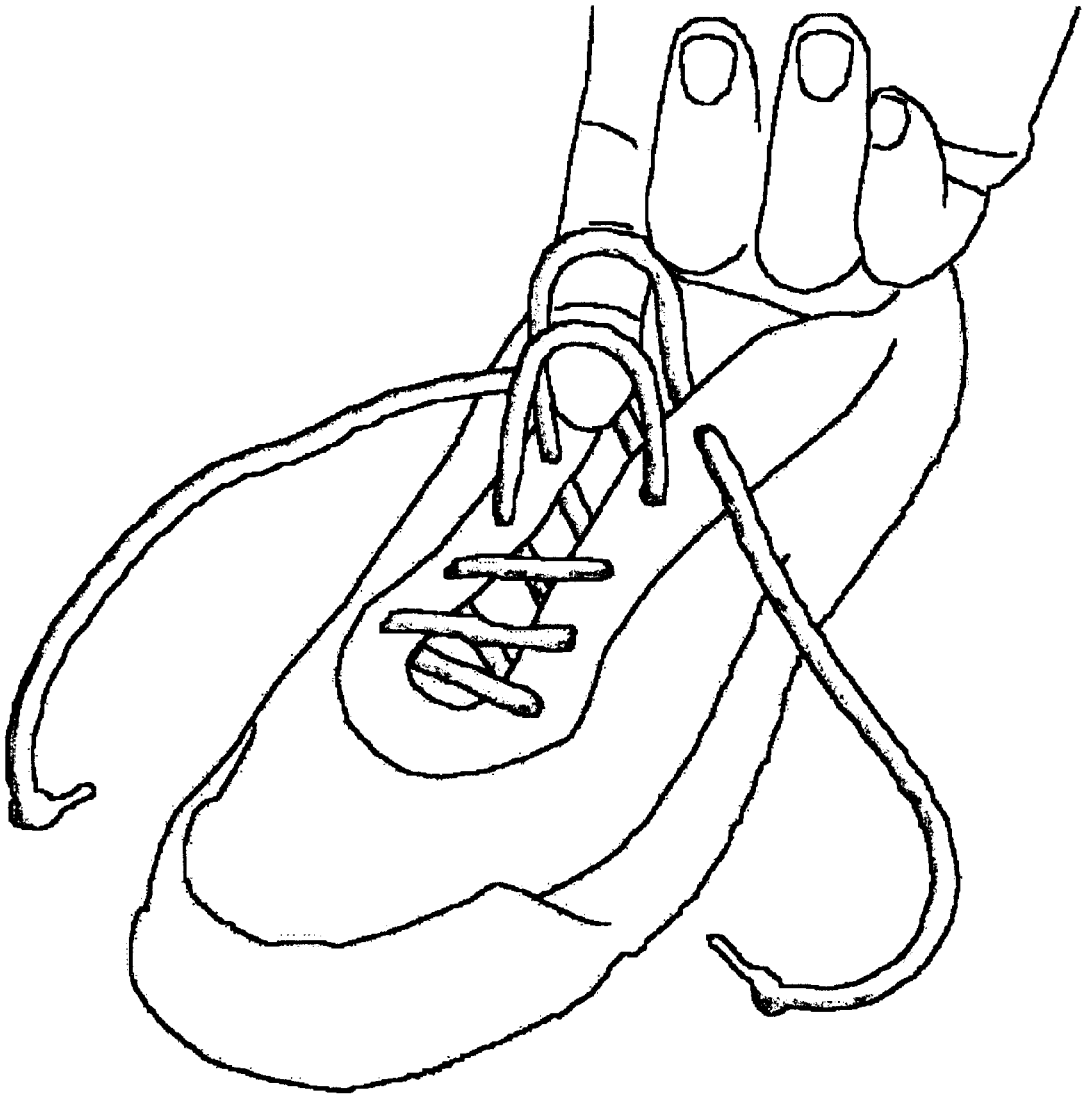
FIG. 9 shows a step in the loosening of the shoelaces in an athletic-type shoe fully laced by the process of the present invention.
Figure 10:
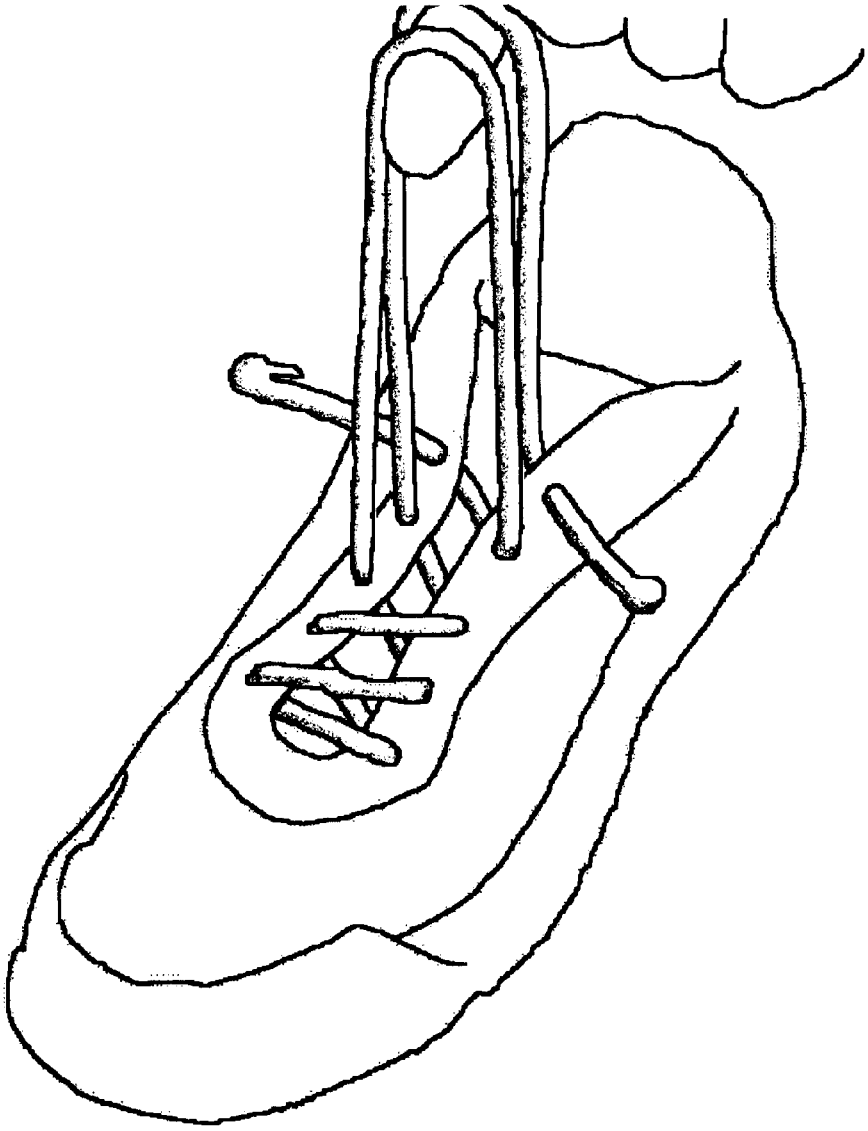
FIG. 10 shows a step in the loosening of the shoelaces in an athletic-type shoe fully laced by the process of the present invention.
Figure 11:
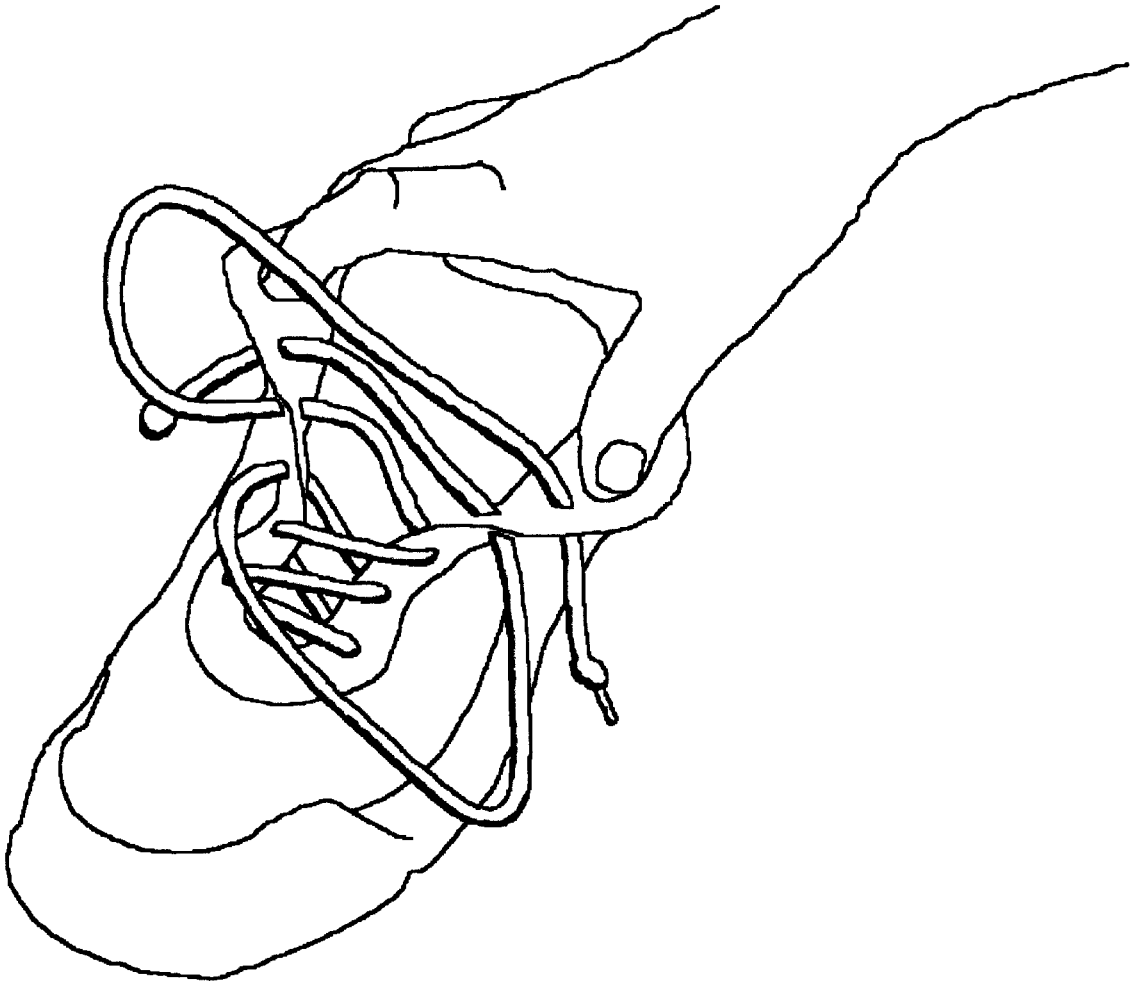
FIG. 11 shows a step in the loosening of the shoelaces in an athletic-type shoe fully laced by the process of the present invention.
Figure 12:
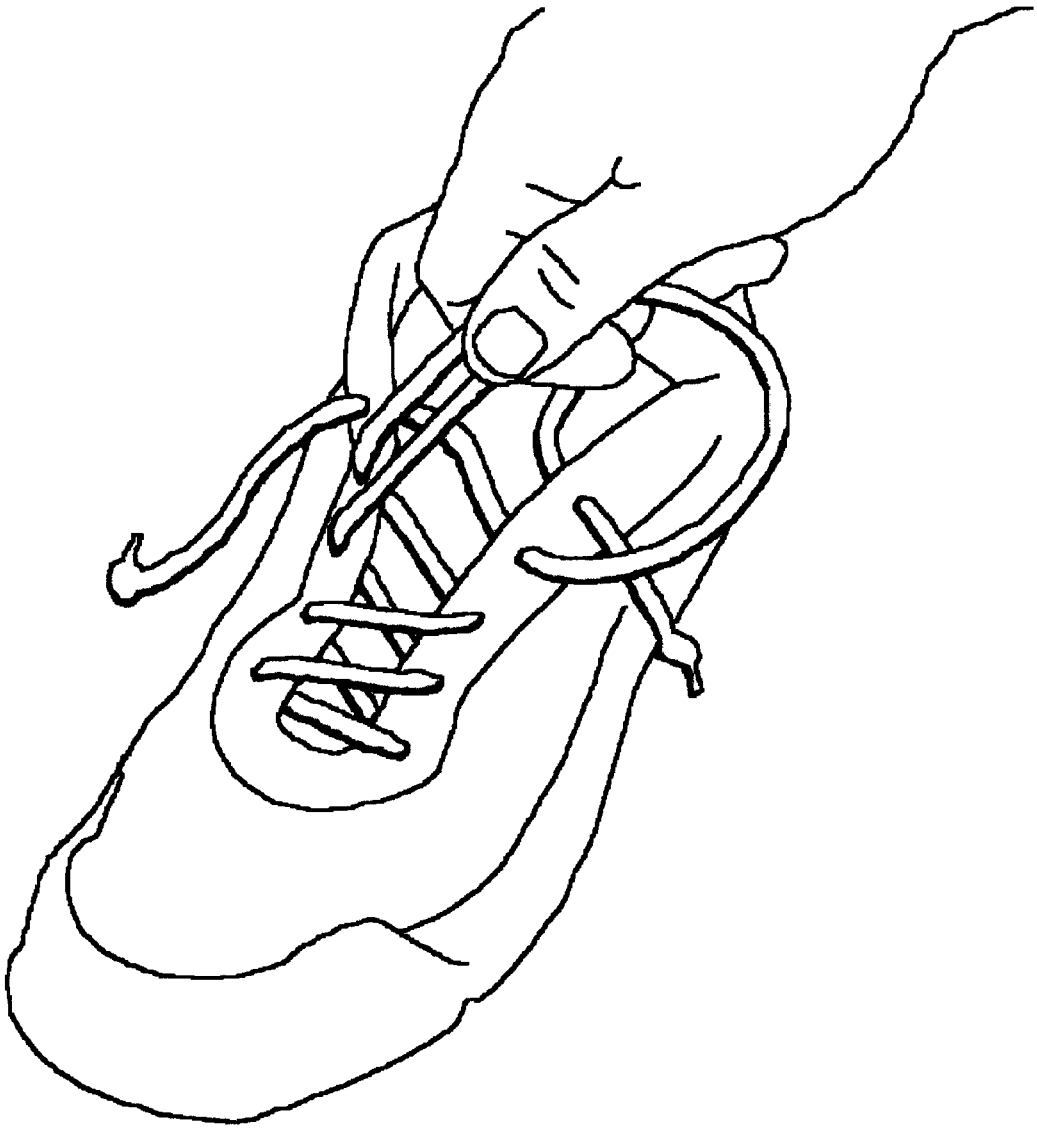
FIG. 12 shows a step in the tightening of the shoelaces in an athletic-type shoe fully laced by the process of the present invention.
Figure 13:
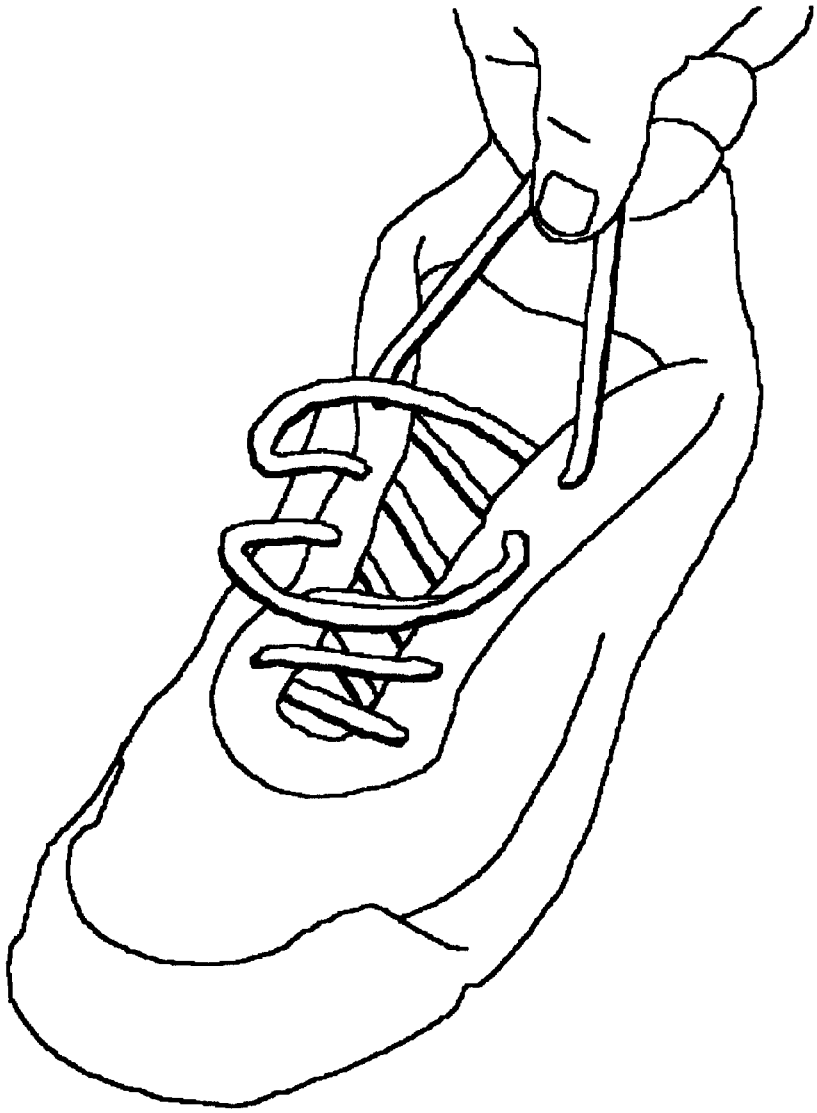
FIG. 13 shows a step in the tightening of the shoelaces in an athletic-type shoe fully laced by the process of the present invention.
Figure 14:
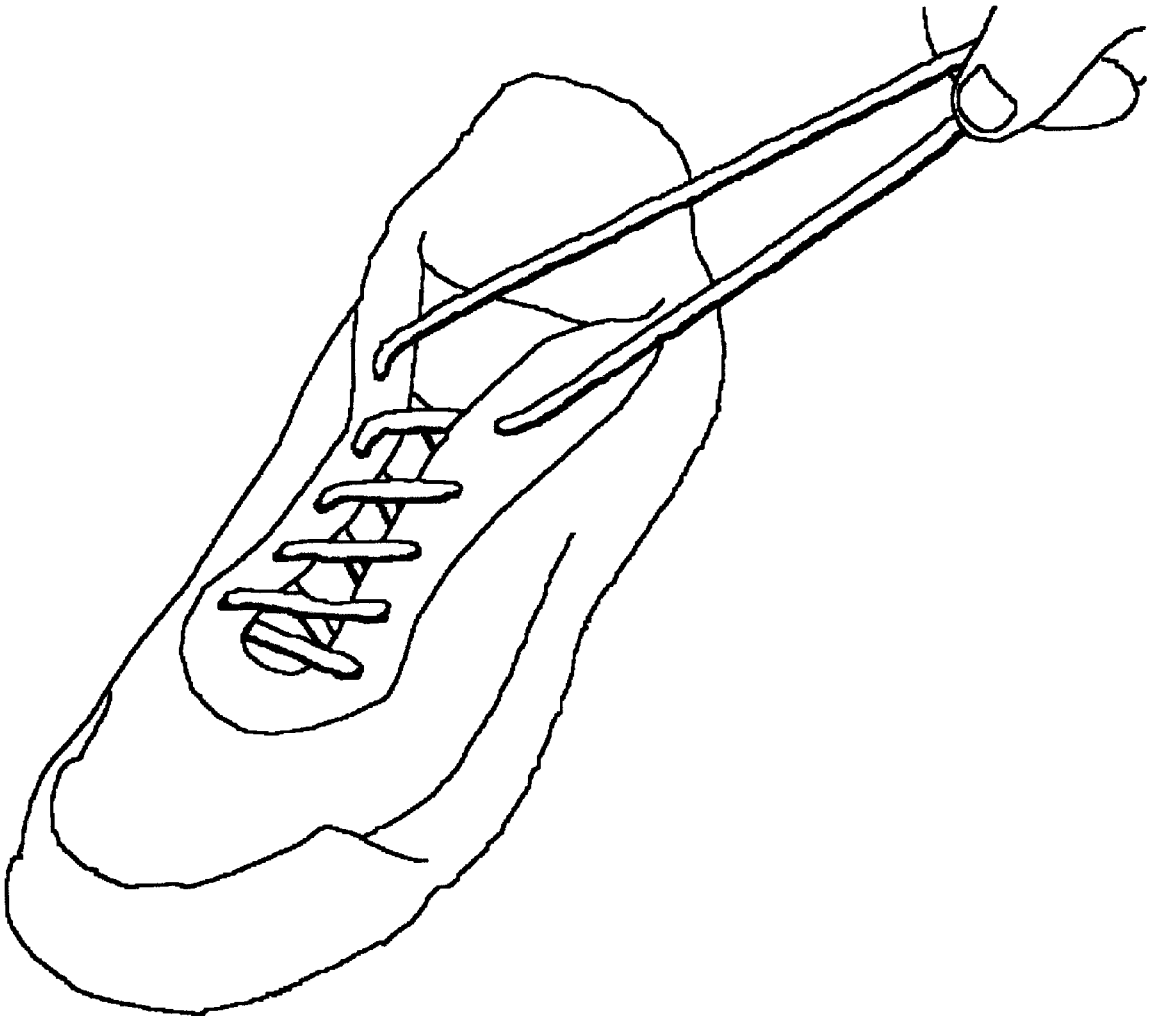
FIG. 14 shows a step in the tightening of the shoelaces in an athletic-type shoe fully laced by the process of the present invention.

The process of the present invention makes it easier to tighten and loosen the shoelaces regardless of how the shoelaces are tightened and loosened. However, because shoelaces laced by the process of the present invention tighten and loosen by moving in the same direction, without the friction caused when the shoelaces cross each other, effect a, the shoelaces can be more quickly and easily tightened and loosened with one hand. FIG. 7 illustrates the shoe lacing process of the present invention with five pairs of lace-holes, and FIG. 8 shows an athletic-type shoe with five pairs of lace-holes, fully laced by the process of the present invention. The shoelaces can be quickly and easily loosened with one hand by lifting with one finger under the top two shoelace segments, as shown in FIGS. 9 and 10, followed by pushing the sides of the shoe upper apart with the thumb and other fingers as shown in FIG. 11. The shoelaces on this shoe can be quickly and easily tightened with one hand by the process of the present invention by first pulling on the lower sides of the two shoelace segments immediately above the two lowest segments that need tightening, as shown in FIG. 12, followed by pulling the shoelace ends to fully tighten the shoelaces as shown in FIGS. 13 and 14.

Figure 15:
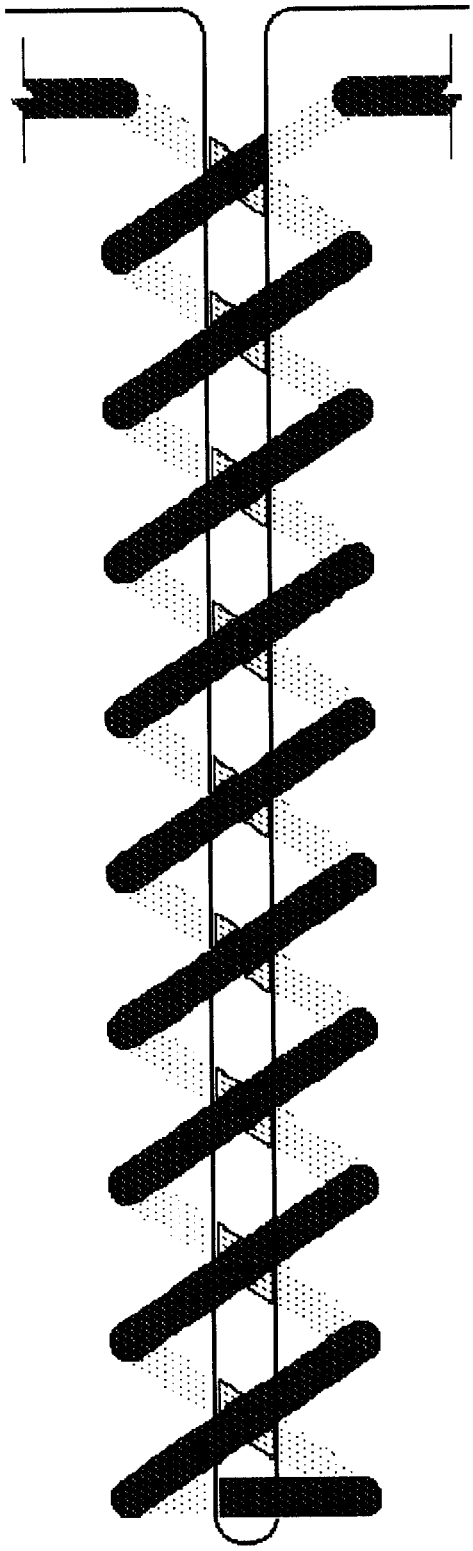
FIG. 15 represents an embodiment of the process of the present invention with 10 pairs of lace-holes.
Figure 16:
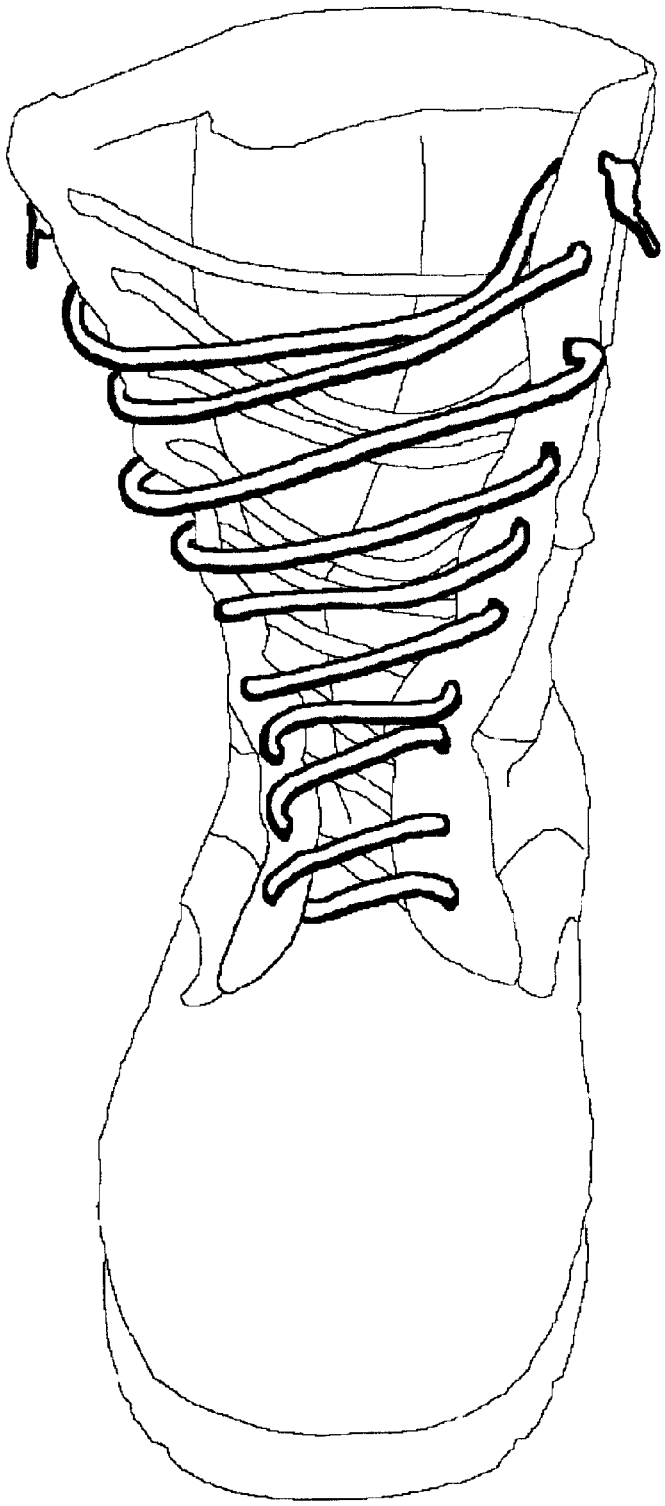
FIG. 16 is a perspective view of a military-style boot with 10 pairs of lace-holes, fully laced by the process of the present invention.
Figure 17:
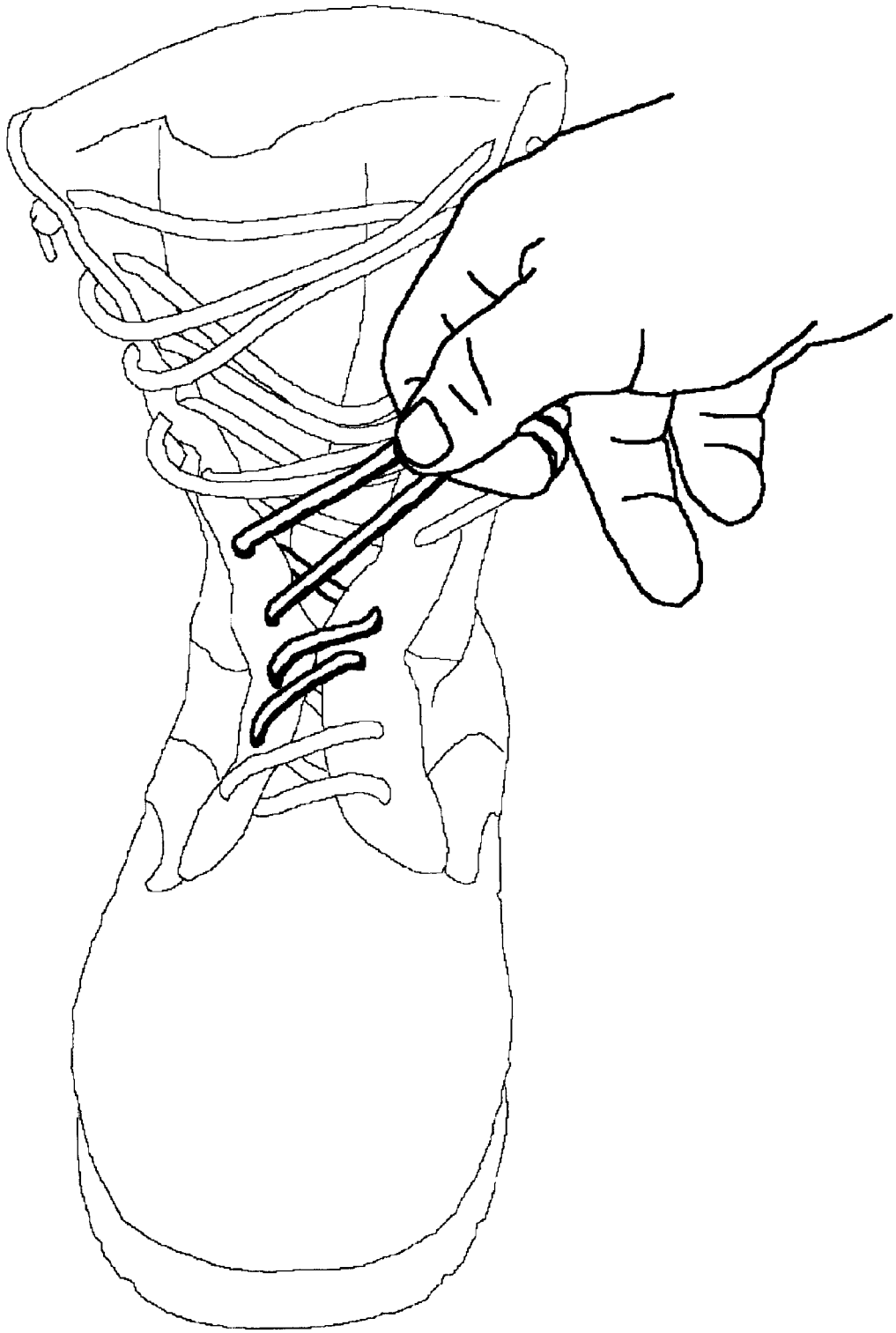
FIG. 17 shows a step in the tightening of the shoelaces in a boot with 10 pairs of lace-holes, fully laced by the process of the present invention.
Figure 18:
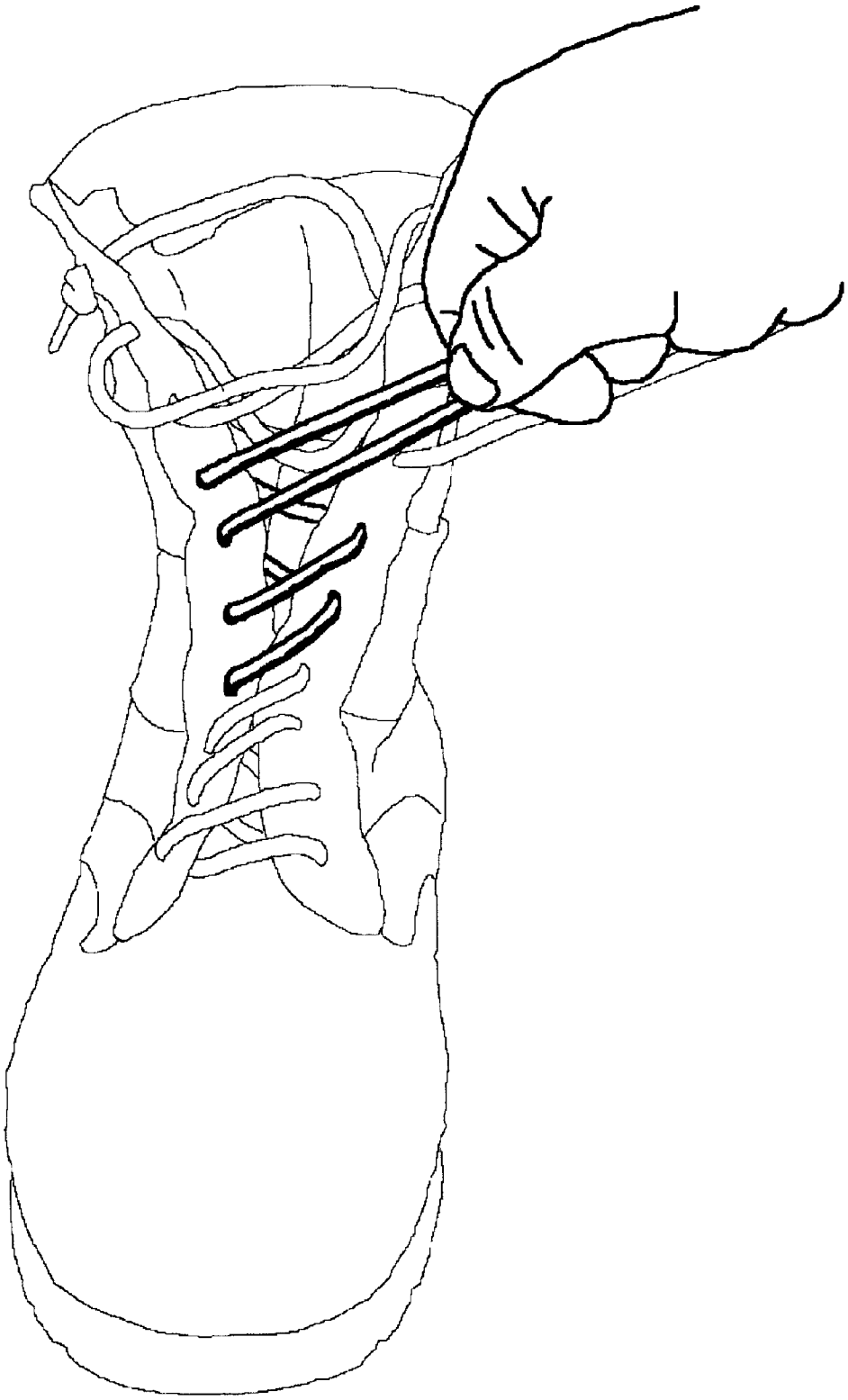
FIG. 18 shows a step in the tightening of the shoelaces in a boot with 10 pairs of lace-holes, fully laced by the process of the present invention.
Figure 19:
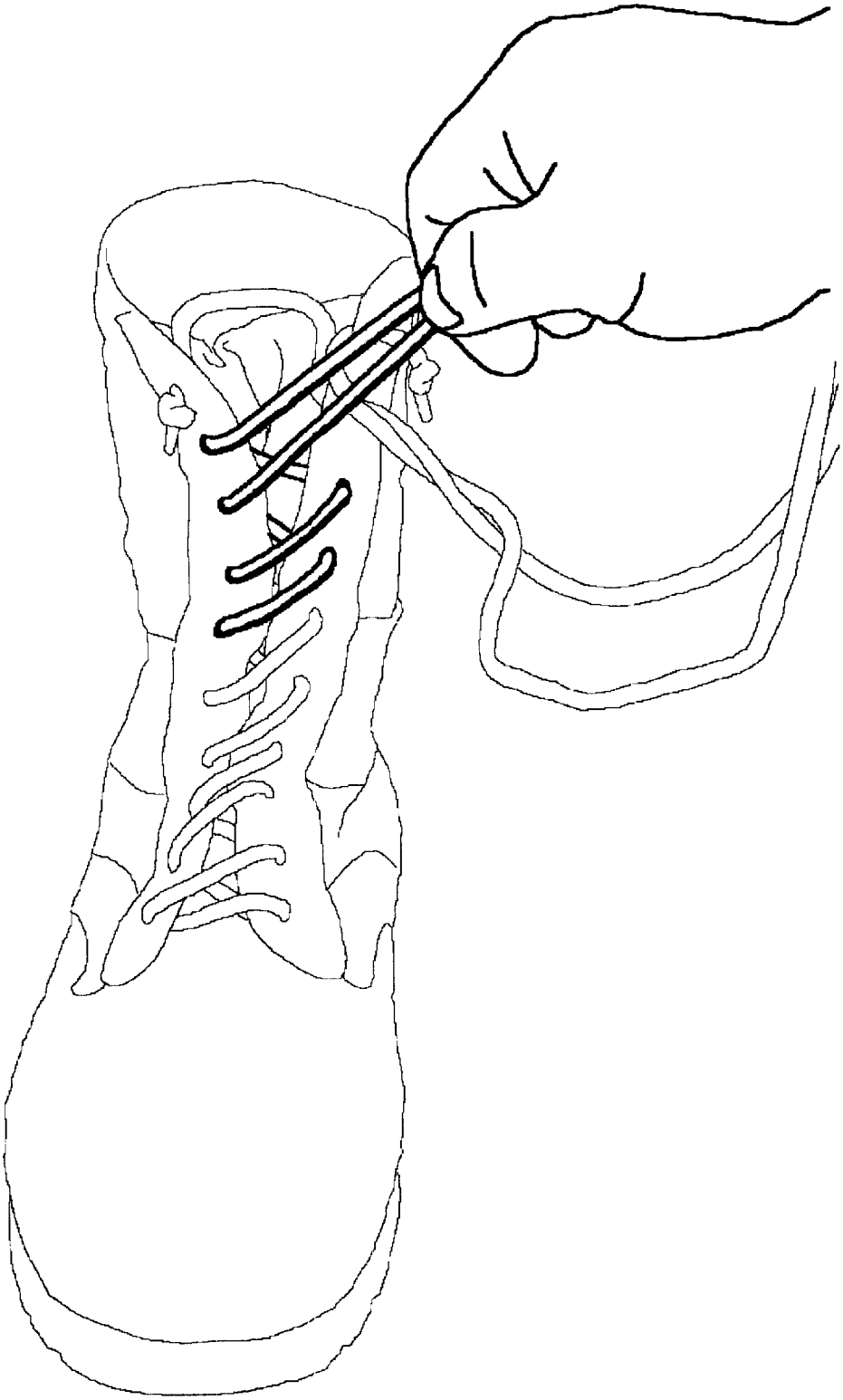
FIG. 19 shows a step in the tightening of the shoelaces in a boot with 10 pairs of lace-holes, fully laced by the process of the present invention.
Figure 20:
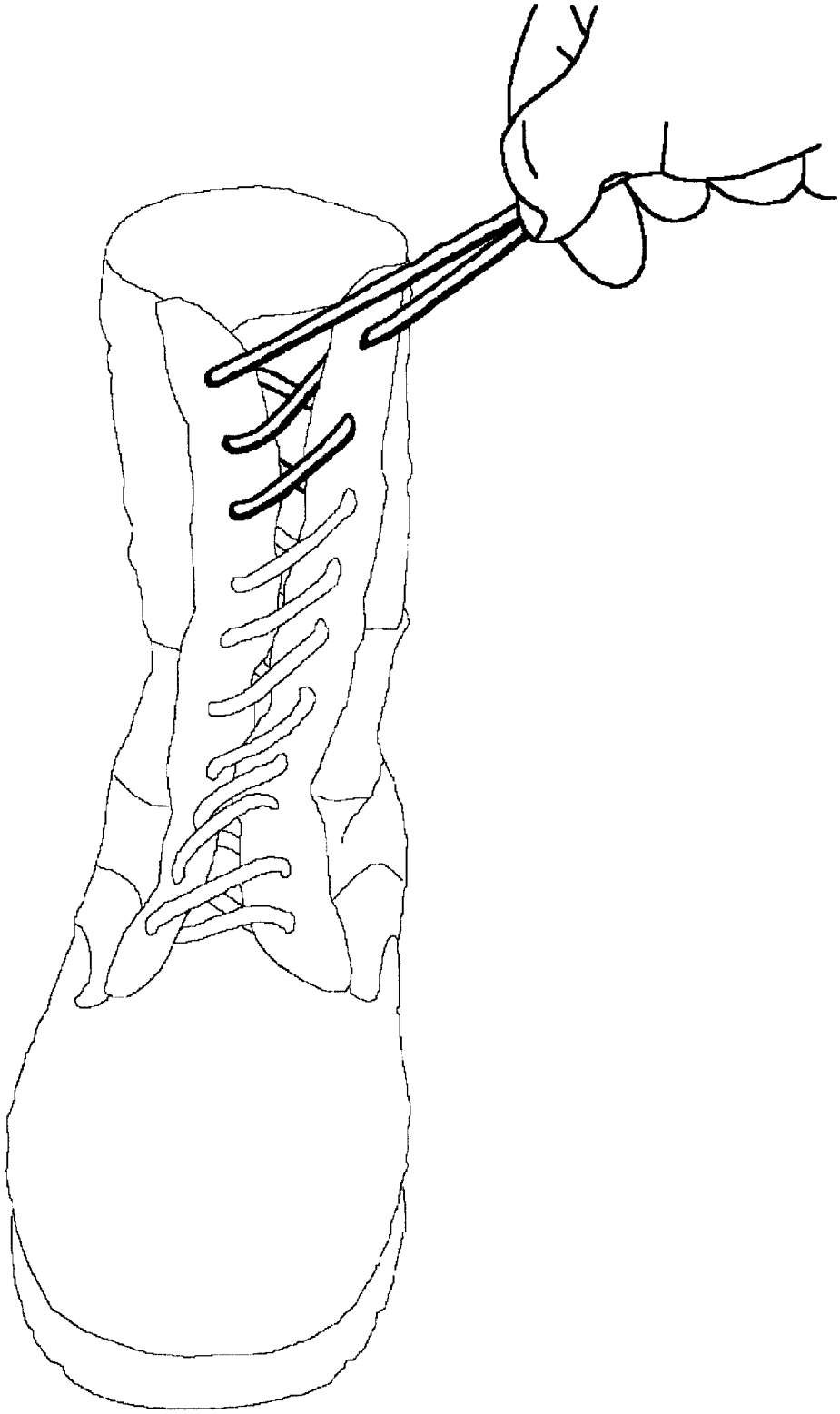
FIG. 20 shows a step in the tightening of the shoelaces in a boot with 10 pairs of lace-holes, fully laced by the process of the present invention.

The advantages of the process of the present invention are greatest in boots, because of the large number of lace-holes and length of the shoelaces cumulate the process' advantages. FIG. 15 illustrates the shoe lacing process of the present invention with ten pairs of lace-holes, and FIG. 16 shows a military-type boot with ten pairs of lace-holes, fully laced by the process of the present invention. The shoelaces can be quickly and easily tightened and loosened in the same general manner as described for the five-lace-hole athletic-type shoe above, repeating the process with sequential pairs of shoelace segments. The tightening process is illustrated in FIGS. 17, 18, 19, and 20.

Figure 21:
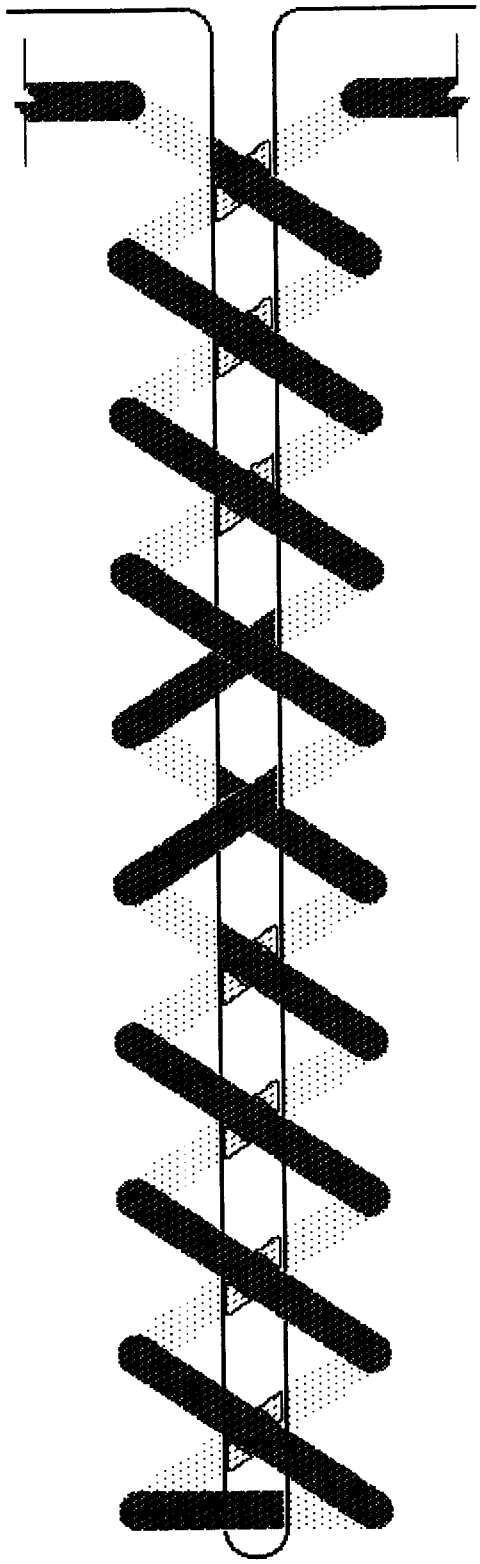
FIG. 21 represents 10 pairs of lace-holes, the lowest 4 laced by the process of the present invention, the $5^{th}$ and $6^{th}$ laced according to the basic crisscross lacing process, and the highest 4 laced according to the process of the present invention.

Because the process of the present invention minimizes friction between all of the lace-holes above the lowest pair, any differences in the relative tightness of the various shoelace segments tend to equalize during the lacing process or immediately thereafter. This is generally beneficial, because it eliminates uncomfortable tight-spots inherent in the common lacing processes. However, there are circumstances in which a wearer desires variation in the tightness of the shoelaces, such as having the shoelaces in a boot tighter directly over the foot but less tight for the part of the boot covering the calf. This desirable effect is achieved in another embodiment of process of the present invention by taking advantage of the high friction inherent in the basic crisscross process. Thus, the upper and lower parts of the boot can be laced with the easily tightened and loosened process of the present invention, with a 2- or 3-hole region between them laced with the friction-maximizing basic crisscross process. For example, FIG. 21 shows 10 lace-hole pairs (such as in the boot shown above), laced by the process of the present invention in the lower four pairs of lace-holes, then laced by the basic crisscross process in the next three pairs of lace-holes, and finishing with the process of the present invention in the final three pairs of lace-holes. The high friction resulting from region laced by the basic crisscross process will tend to maintain the relative tightness or looseness of the regions laced by the process of the present invention.

Figure 22:
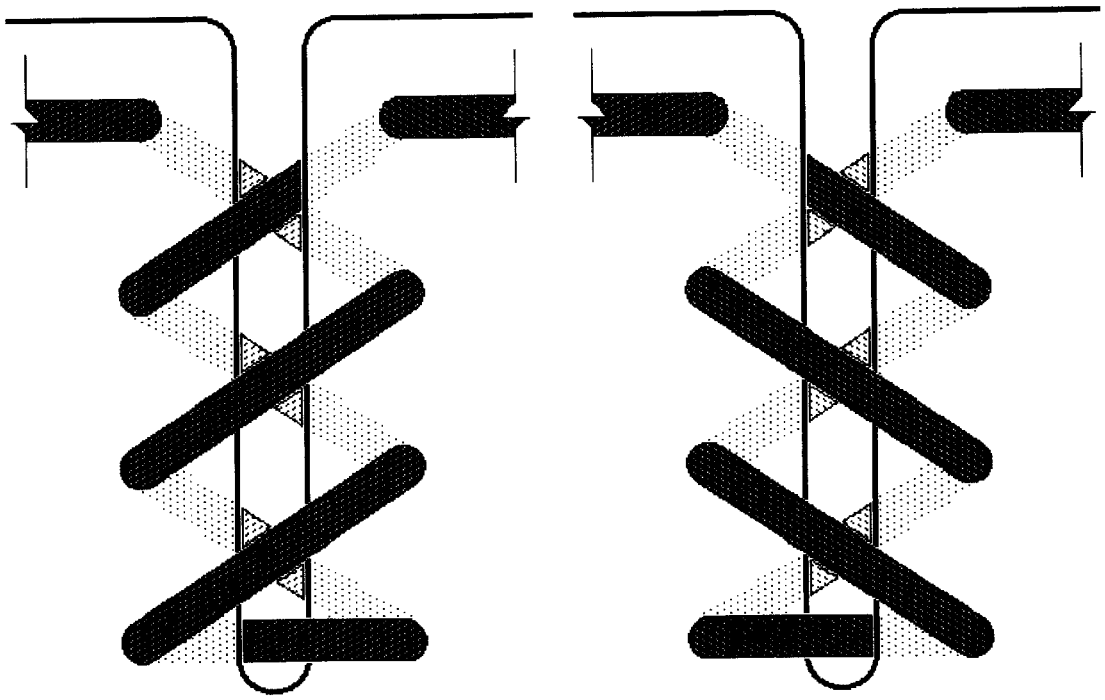
FIG. 22 represents two embodiments of the process of the present invention with 4 pairs of lace-holes, laced in opposite directions on the left and right.
Figure 23:
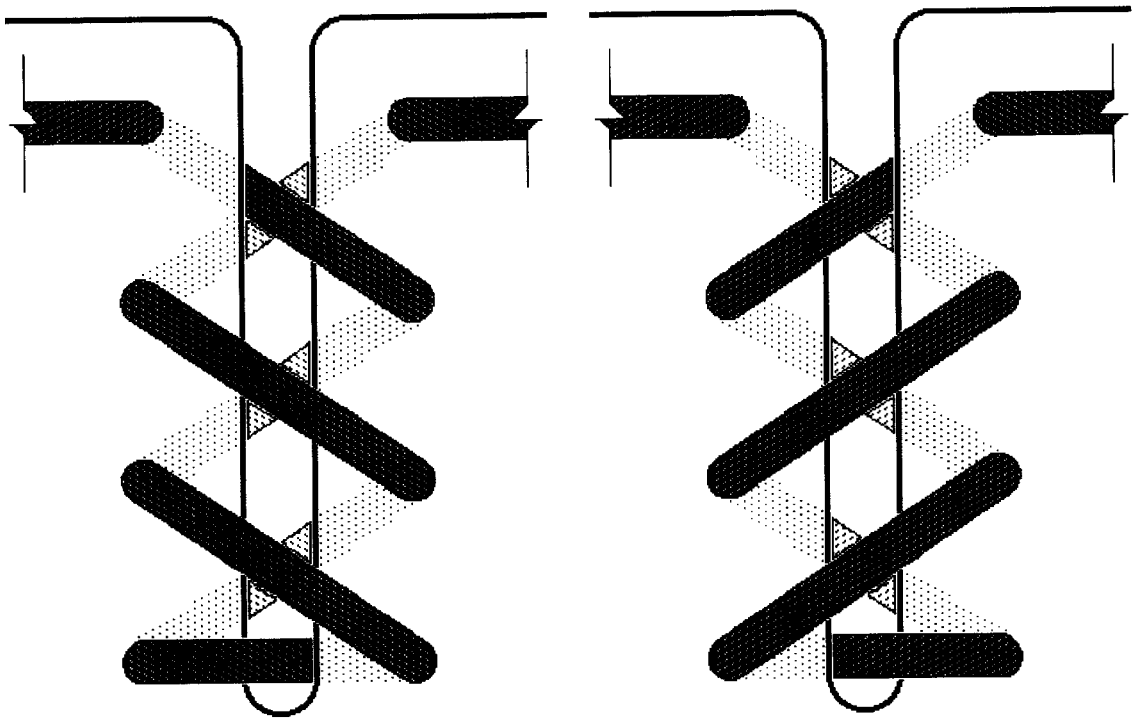
FIG. 23 represents two embodiments of the process of the present invention with 4 pairs of lace-holes, laced in opposite directions on the left and right and the opposite as in FIG. 22.

Embodiments of the process of the present invention with identical utility, with regard to minimizing friction and facilitating tightening and loosening, are obtained depending on whether one begins with the hole designated as hole 1 above (the hole through which the initial lace-end is inserted such that it passes from the underside and emerges on the upperside) on the left or right from the perspective of the wearer. Beginning with hole 1' on the left and hole 1 on the right results in shoelaces that spiral in a double helix in a right-hand screw direction—like, for example, most DNA, which is a ubiquitous naturally-occurring double helix which spirals in a right-hand screw direction. Beginning with hole 1 on the left and hole 1' on the right results in shoelaces that spiral in a double helix in a left-hand screw direction—like, for example, "Z-DNA," which is a relatively rare naturally-occurring double helix which spirals in a left-hand screw direction. FIGS. 22 and 23 show the lacing pattern obtained by lacing the left and right shoes by the process of the present invention, starting with both possible opposite orientations on the left and right shoes.

While many wearers may find it aesthetically preferable to have the left and right shoes laced in opposite directions, as illustrated in FIGS. 22 and 23, the utility advantages of the process of the present invention, with regard to minimizing friction and facilitating tightening and loosening, are identical regardless of the direction. However, there are other functional advantages to lacing the shoes by the process of the present invention with the orientation as shown in FIG. 22. Shoes and boots laced with the process of the present invention with this orientation are less prone to having the shoelaces snagged when coming into contact with underbrush, cactus, or other sharp projections, because the shoelace segments on the upper outer surface of the boot point upward and inward, away from the direction that sharp projections come into contact with the forward-moving boot. In contrast, shoes laced by any of the common lacing processes, or the process of the present invention as shown in FIG. 23, present shoelace segments that are oriented in a direction more likely to be snagged by coming into contact with sharp projections when the boot moves forward.

Shoes laced by the process of the present invention as shown in FIGS. 22 and 23 also have functional advantages in circumstances in which it is desirable to minimize the disruption of airflow across the shoe surface, such as speed skating and time-trial bicycling.

Another embodiment of the process of the present invention is obtained by employing means, after the shoe is fully laced, to prevent the lace-ends from being pulled out of the holes when the shoelaces are loosened. This embodiment is obtained most simply by tying a standard overhand knot at the very end of the lace-ends after the shoe is fully laced according to the process of the present invention. FIGS. 8 and 16 illustrate shoes laced by the process of the present invention with standard overhand knots tied at the ends of the shoelaces.

The process of the present invention applies to the use of any shoelaces in any shoes with at least 2 pairs of lace-holes. The term "lace-holes" is used broadly to include holes cut into the material of the shoe upper itself, as well as rings, eyelets, or any other means that guide the shoelaces in a direction orthogonal to the proximal surface of the shoe upper. The advantages of the process of the present invention are obtained with any type of lace-hole.

The shoelaces used in the process of the present invention can be of the same length and type used with the common lacing processes, and the tightened shoelaces can be secured by the standard bow knot, other knots, or any other means, just as with the common lacing processes. Just as a shoelace made of material with a lower coefficient of friction can be tightened more easily with the common lacing processes than a shoelace with higher friction, different kinds of shoelaces also handle differently in the same shoe when laced with the process of the present invention. However, shoes laced by the process of the present invention will invariably be easier to tighten and loosen than with the same shoelace laced by other processes.

The basic features and advantages of the process of the present invention are described above. However, it is understood that these particular descriptions and illustrations are merely examples of the principles of the process of the present invention, and other embodiments are possible within the spirit and scope of the invention as defined in the claims.

I claim:

1. A process for lacing a shoe having a plurality of lace-holes in two parallel rows, with a shoelace, in which the path followed by the shoelace describes a double helix, comprising the following steps:

initial insertion of one lace-end through the lowest lace-hole in one of the rows of lace-holes, entering the upper surface of the lace-hole and emerging on the under surface;

insertion of the other lace-end through the lowest lace-hole in the other row of lace-holes, entering into the under surface of the lace-hole and emerging on the upper surface;

pulling the lace-ends until there is no substantial slack in the shoelace between the lowest pair of lace-holes and each side of the unlaced shoelace is of approximately equal length;

sequentially, for each of the remaining pairs of lace-holes:

inserting the lace-end that emerges on the under surface of a lace-hole into the under surface of the next higher lace-hole on the opposite side, inserting the lace-end that emerges on the upper surface of a lace-hole into the upper surface of the next higher lice-hole on the opposite side, and pulling both lace-ends until there is no substantial slack in the shoelace between the lace-holes; and finishing when shoelace has been passed through the highest pair of lace-holes desired to be laced;

wherein the process of said shoelace double helix resulting in reduced friction for faster and easier tightening and loosening said shoelace.

2. The process of claim 1 in which the path followed by the shoelaces describes a double helix for all of the lacing path except the final pair of lace-holes.

3. The process of claim 1 in which the path followed by the shoelaces describes a double helix for a portion of the lacing path.

4. The process of claim 1 in which, after lacing is complete, means are employed to prevent the ends of the shoelaces from pulling through the lace-holes during loosening of the shoelaces.

5. The process of claim 1 in which the path followed by the shoelaces describes a double helix that spirals in a left-hand screw direction.

6. The process of claim 1 in which the path followed by the shoelaces describes a double helix that spirals in a right-hand screw direction.

7. The process of claim 1 in which the path followed by the shoelaces on the left shoe describes a double helix that spirals in a right-hand screw direction and the path followed by the shoelaces on the right shoe describes a double helix that spirals in a left-hand screw direction.

8. The process of claim 1 in which the path followed by the shoelaces on the left shoe describes a double helix that spirals in a left-hand screw direction and the path followed by the shoelaces on the right shoe describes a double helix that spirals in a right-hand screw direction.

* * * * *